United States Patent [19]

Fukayama

[11] Patent Number: 4,637,348

[45] Date of Patent: Jan. 20, 1987

[54] APPARATUS FOR CONTROLLING STARTING OPERATION OF BOILER

[75] Inventor: Yukio Fukayama, Hiroshima, Japan

[73] Assignee: Babcock-Hitachi Kabushiki Kaisha, Tokyo, Japan

[21] Appl. No.: 754,963

[22] Filed: Jul. 15, 1985

[30] Foreign Application Priority Data

Jul. 16, 1984 [JP] Japan ..... 59-145932

[51] Int. Cl.[4] ..... F22B 35/04

[52] U.S. Cl. ..... 122/406 ST; 122/448 R; 122/451.2; 122/452; 122/479 R; 236/14

[58] Field of Search ..... 122/406 ST, 406 R, 406 S, 122/448 R, 448 A, 448 S, 451 S, 451.1, 451.2, 452, 479 R; 236/14, 15 C, 24.5, 26 A

[56] References Cited

U.S. PATENT DOCUMENTS

| | | | |
|---|---|---|---|
| 3,828,737 | 8/1974 | Fujii et al. | 122/406 ST |
| 3,877,636 | 4/1975 | Sato | 236/14 |
| 3,908,897 | 9/1975 | van Holtz et al. | 236/14 |
| 4,031,863 | 6/1977 | Laubli | 236/14 X |
| 4,144,846 | 3/1979 | Miszak | 122/451 S |
| 4,241,701 | 12/1980 | Morse | 236/14 X |
| 4,262,636 | 4/1981 | Augsberger | 122/406 ST |

*Primary Examiner*—Albert J. Makay
*Assistant Examiner*—Steven E. Warner
*Attorney, Agent, or Firm*—Antonelli, Terry & Wands

[57] ABSTRACT

An apparatus for controlling a starting operation of a boiler which comprises a super heater, a super heater bypass valve, a turbine bypass valve and a fuel flow rate regulating valve. A temperature detector detects a temperature of the steam at a predetermined portion of the boiler. A pressure detector detect a pressure of the steam at the predetermined portion of the boiler. A desired change rate arithmetic unit calculates a desired steam temperature change rate value and a desired steam pressure change rate value on the basis of the steam pressure, the steam temperature, a desired pressure increase value, a desired temperature increase value, a saturated temperature change rate limit and a temperature increase change rate limit. An optimum operation arithmetic unit calculates opening degrees of the super heater bypassing valve, turbine bypass bypass valve and the fuel flow rate regulating valve, respectively, on the basis of the steam temperature, the steam pressure, the desired steam pressure change rate value and the desired steam temperature change rate value obtained by the desired change rate arithmetic unit. A compensation arithmetic unit compensates for the respective opening degrees obtained by the optimum operation arithmetic unit, on the basis of the change rates of the steam temperature and pressure.

8 Claims, 22 Drawing Figures

FUEL
$t_0$
$t_1$
$t_2$
$t_3$
TIME

OPENING DEGREE OF SUPER HEATER BYPASS VALVE
$t_0$
$t_1$
$t_2$
$t_3$
TIME

OPENING DEGREE OF TURBINE BYPASS VALVE
$t_0$
$t_1$
$t_2$
$t_3$
TIME

VAPOR PRESSURE
$P_1$
$P_0$
$t_0$
$t_1$
$t_2$
$t_3$
TIME

TEMP. OF VAPOR IN OUTLET OF SUPER HEATER
$t_0$
$t_1$
$t_2$
$t_3$
TIME

APPARATUS FOR CONTROLLING STARTING OPERATION OF BOILER

BACKGROUND OF THE INVENTION

The present invention relates to an apparatus for controlling a starting operation of a boiler.

In a boiler starting operation, after a preparatory operation has been accomplished, a fuel supply system is operated with a burner being ignited, to thereby start increasing of a pressure and a temperature of the boiler. In this case, it is necessary to suitably control the starting operation in order to prevent each part of the boiler from being overheated or to prevent parts, having a greater thickness, of the boiler from being subjected to an excessive thermal stress.

Disadvantages encountered in a conventional apparatus for controlling a starting operation of a boiler reside in the fact that it is difficult to set an optimum temperature and pressure increase pattern which refers to a starting state where the temperature and pressure increases are accomplished in a minimum period of time while suppressing a thermal stress generation in parts, having a greater thickness, of the boiler. The greater thickness portions which are most important in the boiler are, generally, an outlet header of a super heater and the system separator (or drum). Therefore, the optimum temperature and pressure increase pattern is intended to mean a state in which a change rate of the outlet steam temperature of the super heater which rate, hereinafter referred to as a temperature increase rate, effects a thermal stress of the outlet header of the super heater 5 and a change rate hereinafter referred to as a pressure increase rate, of the steam pressure which effects a thermal stress of the steam separator (or drum) through the saturated temperature change are maintained just below the change rate limits allowable in light of the suppression of the thermal stress generation.

In the conventional apparatus, the temperature increase rate and the pressure increase rate are regulated by setting of function generators and, in order to carry out such setting, it is necessary to determine the rates by repeating the starting tests of actual drums. This requires a number of steps and is troublesome. Further, in the case where the steam pressure at the ignition time (initial pressure) is different from the steam pressure at which the adjustment is carried out, the actual rates would be offset from the desired temperature and pressure increase rates. In order to prevent such offset from generating, the function generators are operated to set the temperature and pressure increase rates so that they do not exceed the limits in a starting state under any initial pressure and in any step of the temperature and pressure increase process. As a result, the obtained temperature and pressure increase pattern is considerably offset from the optimum temperature and pressure increase pattern, and the consumed starting period is rather longer than that according to the optimum temperature and pressure increase pattern.

Moreover, in a conventional apparatus for controlling a starting operation of a boiler, it is difficult to reduce the starting loss. More particularly, case where the starting operation is carried out in accordance with predetermined temperature and pressure increase rates, a combination among the fuel replenishment amount running through a fuel flow rate regulating valve, the opening degree of a super heater bypass valve and an opening degree of the turbine bypass valve is not determined to a sole combination. Namely, there may be a combination where a great amount of fuel is replenished to the burner of the boiler, whereas, a great amount of steam is bypassed by a super heater bypass valve and a turbine bypass valve, and there is another combination reverse to the former combination. In the various combinations, a three-factor combination where it is possible not only to maintain the given temperature and pressure increase rates but to reduce the opening degree of the fuel flow rate regulating valve to a minimum may lead to an operation where the starting loss is minimized for the same starting period. However, the conventional apparatus does not function to cooperate the super heater bypass valve, the turbine bypass valve and the fuel flow rate regulating valve with each other. Therefore, in order to reduce the starting loss, there is no method other than a method of independently adjusting an opening degree setter and the function generators. As a matter of fact, it is almost impossible to adjust these components in such a manner that the starting loss is kept at a minimum while maintaining the above-described optimum temperature and pressure increase rates.

Additionally in the conventional apparatus for controlling a starting operation of a boiler, even if the temperature and pressure increase pattern becomes abnormal due to a disturbance or the like, any modification copying with such abnormal operation is not performed. More particularly, although the temperature and pressure increase rates are important state factors by which a thermal stress of the greater thickness portions of the boiler is governed, the conventional apparatus has no method of measuring these factors. In the conventional apparatus, these factors are out of the control. For this reason, if the temperature and pressure increase rates deviate from a pattern planned in adjusting the opening degree setter and the function generators due to a distrubance or the like, it is impossible to modify the deviation. Therefore, also in view of this aspect, it is necessary to plan the temperature and pressure increase rates at somewhat lower levels upon adjusting the opening degree setter and the function generators while estimating a margin of the suppression of thermal stress generation. This is one of the hindering factors of the starting period reduction.

An object of the present invention is to provide a boiler starting operation controlling apparatus which is capable of accomplishing a starting operation of a boiler in a short period of time while suppressing a thermal stress generated in greater thickness portions of the boiler and which is capable of reducing a starting loss.

In order to attain the object, in accordance with the present invention a steam or temperature and a steam or vapor pressure are detected, a desired value of a steam temperature change rate and a desired value of a steam pressure change rate needed for suppression of a thermal stress of greater thickness portions of a boiler are calculated based upon the detected values, a desired pressure increase value, a desired temperature increase value, a limit for a saturated temperature change rate which is given by preset constant or function of signal respecting a thermal stress of steam separator, and a limit for a super heater outlet temperature change rate which is given by presetted constant or function of signal respecting a thermal stress of super heater outlet header, and means are provided for calculating the respective operational amounts of a super heater bypass valve, a turbine bypass valve and a fuel flow rate regulating valve based upon the respective desired values, the steam temperature and the steam pressure. The present invention is further characterized in that the operational amounts obtained through these calculations are compensated based upon the change rate of the steam temperature and the change rate of the steam pressure.

BRIEF DESCRIPTION OF THE DRAWINGS

FIG. 18(*b*) is a graphical illustration of a change of an opening degree of a superheater bypass valve with respect to time;

FIG. 18(*c*) is a graphical illustration of a change of an opening degree of the turbine bypass valve with respect to time;

FIG. 18(*d*) is a graphical illustration of a steam or vapor pressure with respect to time; and FIG. 18(*e*) is a graphical illustration of a superheater outlet steam temperature with respect to time.

DETAILED DESCRIPTION

The present invention will now be described by way of example in accordance with shown embodiments.

Figure 17:
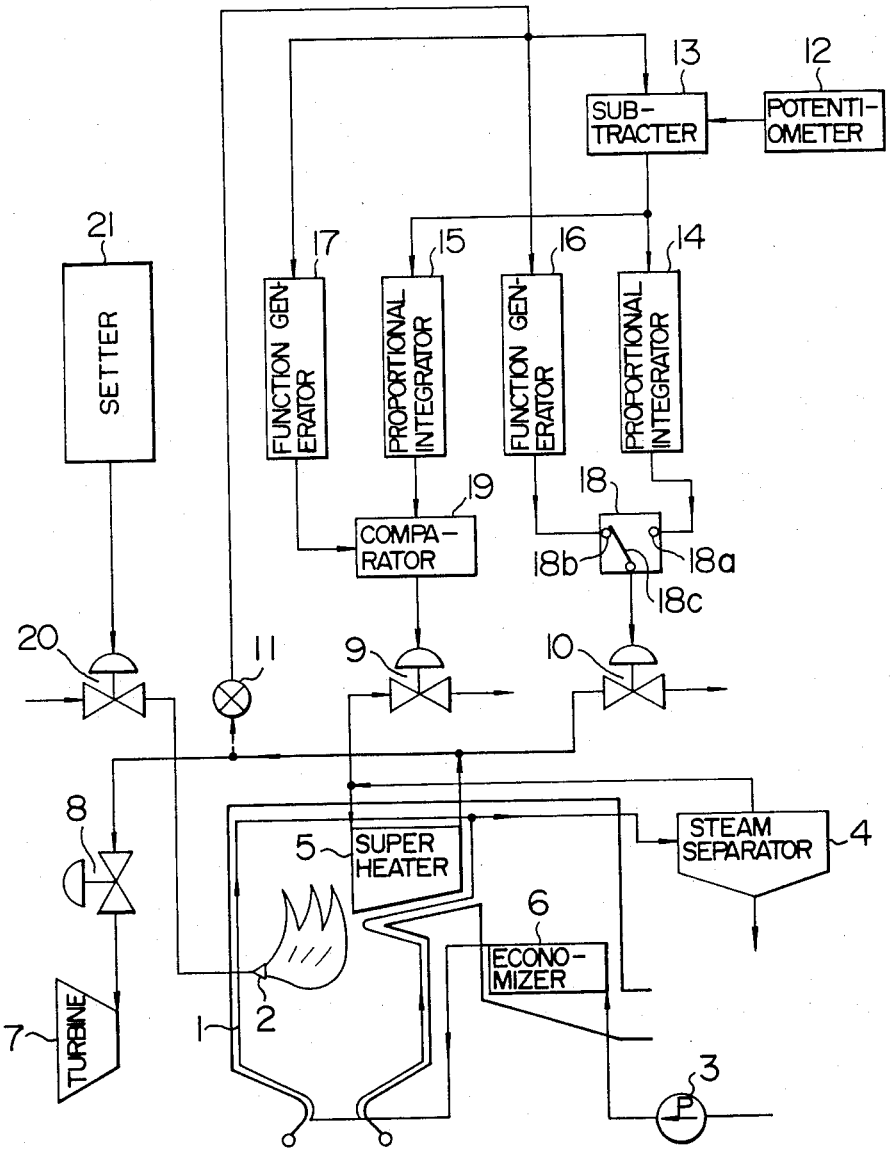
FIG. 17 PRIOR ART
FIG. 17 is a schematic view of a conventional boiler starting operation controlling apparatus.

Referring now to the drawings wherein like reference numerals are used throughout the various views and, more particularly, to FIGS. 17 and 18, according to these figures, a conventional boiler starting operation controlling apparatus of the type described hereinabove includes a water wall 1 forming a boiler furnace wall, a burner 2 and a boiler water feed pump 3 for supplying water to the water wall 1. A steam separator 4 separates steam-water mixture, generated by the feed water heated in the heater wall 1, into steam and water, respectively. A super heater 5 superheats the steam from the steam separator 4, with an economizer 6 preheating the feed water of the water feed pump 3, and a turbine operatively connected to a power generator (not shown). A regulating valve 8 is interposed between the super heater 5 and the turbine 7 for adjusting a rate of steam flow from the super heater 5 to the turbine 7, and a valve 9 allows the steam from the steam separator 4 to flow to a condenser or the like. Upon the starting operation of the boiler, a great amount of steam, maintained at a lower temperature, is introduced into the super heater 5 to thereby prevent the temperature at the outlet of the super heater 5 from being elevated, the valve 9 may bypass such lower temperature steam to reduce the steam flow passing through the super heater 5, thereby elevating the steam temperature at the outlet of the super heater 5. A valve 10 allows steam from the outlet of the super heater 5 to flow to a condenser or the like. Where the temperature and pressure of the steam from the super heater 5 are not increased to such an extent that the steam may flow to the turbine 7, the valve 10 may bypass the steam. Furthermore, where the running steam flow rate is low after the steam has been introduced into the turbine 7, it is difficult to control the steam pressure solely in accordance with the fuel supply amount. Thus, in such an operated condition, the valve 10 allows the generated steam to be bypassed and controls the steam pressure.

The conventional apparatus further includes a steam pressure detector 11 for detecting the pressure of steam to be fed from the super heater 5 to the turbine 7, a steam pressure setter (potentiometer) 12 for setting the pressure level to which the steam is to be regulated, that is, a desired steam pressure, and a subtractor 13 for calculating a difference between a value set by the steam pressure setter 12 and value detected by the steam pressure detector 11. Proportional integrators 14, 15 proportionally integrate the pressure deviation signal outputted from the subtractor 13. The valve detected by the steam pressure detector 11 is inputted into a function generator 16 which, in turn, outputs a predetermined value inn correspondence with the inputted value. The signal outputted from the function generator 16 becomes an opening degree command signal which commands an opening degree of the turbine valve 10 for regulating the steam pressure to a suitable level. In the same manner, the value detected by the steam pressure detector 11 is inputted into another function generator 17 which, in turn, outputs a signal in correspondence with the inputted value. The signal outputted from the function generator 17 becomes an opening degree command signal which commands an opening degree of the super heater by pass valve 9 for regulating the steam flow through the super heater 5 to a suitable level. A signal switcher 18 is provided with terminals 18*a*, 18*b* and a switching member 18*c*. The terminals 18*a*, 18*b* and the switching member 18*c* are electrically connected to the proportional integrator 14, the function generator 16, and the turbine bypass valve 10, respectively. A higher level selector 19 compares the output signal from the proportional integrator 15 with the output signal from the function generator 17 and outputs the higher level signal of the two signals to the super heater bypass valve 9. A fuel flow rate regulator 20 controls the fuel supply amount to the burner 2. An opening degree setter 21 sets an opening degree of the fuel flow rate regulator 20 in accordance with the number of burner units.

Figures 18A, 18B, 18C, 18D, 18E:
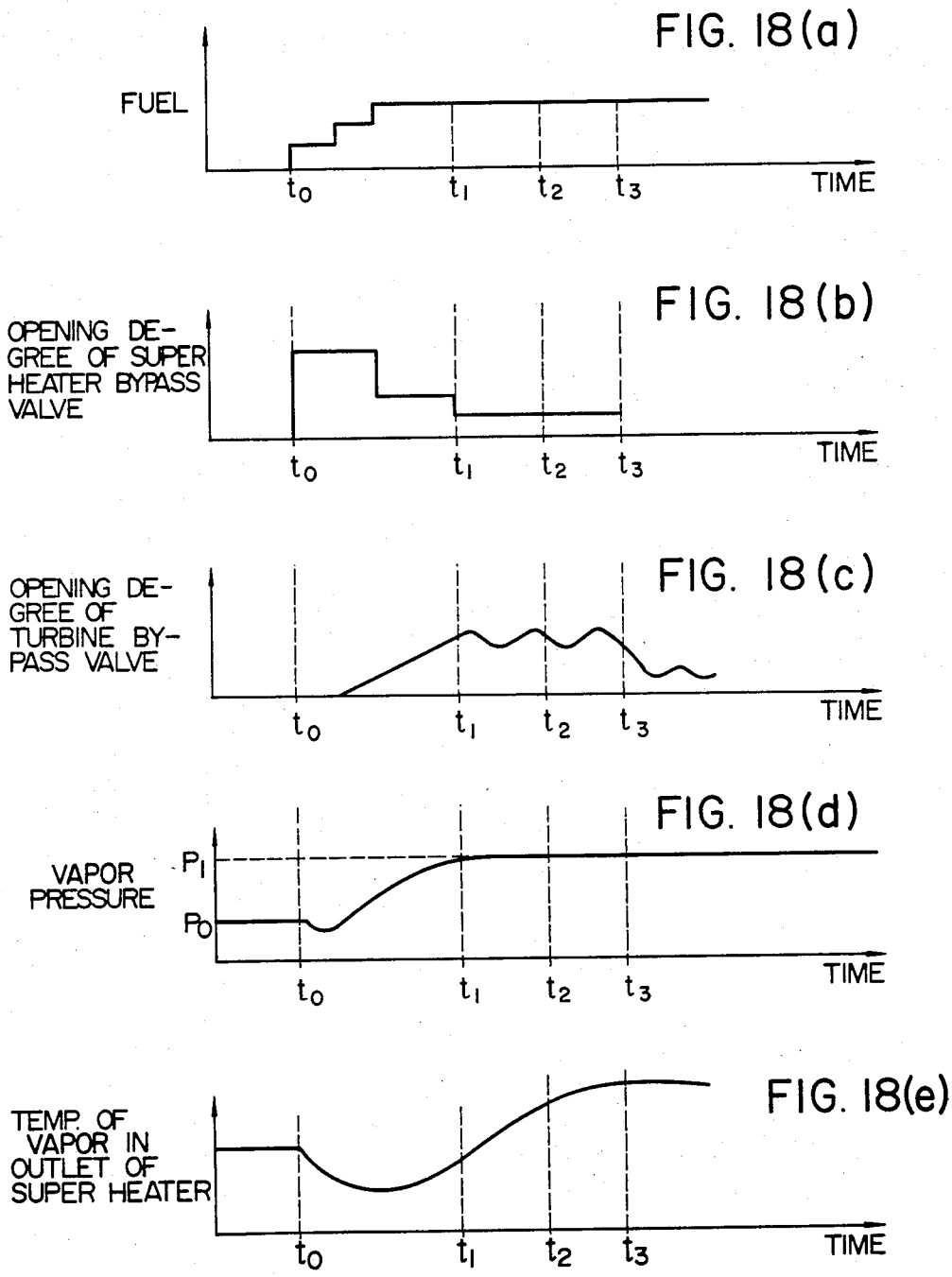
FIG. 18(*a*) is a graphical illustration of a change of fuel replenishment rate with respect to time.

In the graphical illustrations of FIGS. 18(*a*)–18(*e*), $t_0$ is the ignition time, $t_1$ is the pressure increase accomplishment time, $t_2$ is the temperature increase accomplishment time, and $t_3$ is the turbine steam supply time.

Additionally, $p_0$ is the initial steam pressure and $p_1$ is the desired pressure increase value.

After the ignition time of $t_0$, the number of the ignited units of the burner 2 is increased in a stepwise manner and, as a result, the opening degree of the fuel flow rate regulating valve 20 is controlled in accordance with the opening degree setter 21 so that the fuel replenishment amount is increased stepwise in a manner illustrated in FIG. 18(*a*). Before the steam or vapor pressure reaches the desired pressure increase value $p_1$ the signal switcher 18 is under such a condition that at switching number 18*c* is switched to the terminal 18*b;* therefore, the opening degree of the turbine bypass valve 10 is controlled by the output signal from the function generator 16 corresponding to the steam pressure detected by the steam pressure detector 11 until the steam pressure reaches the desired pressure increase value $p_1$. Namely, the opening degree of the turbine bypass valve 10 is determined solely in dependence upon the above-described steam pressure.

Before the turbine steam supply time $t_3$, the opening degree of the turbine bypass valve 10 is controlled so that the increased steam pressure is bypassed as shown in FIG. 18(*c*). Additionally, since a saturated temperature of the steam is low when the steam pressure is maintained low and a low temperature steam is supplied to the steam separator 4 to the super heater 5, the output signal of the function generator 16 becomes a signal by which the opening degree of the super heater bypass valve 9 is increased. Consequently, the opening degree of the super heater bypass valve 9 is increased as shown in FIG. 18(*b*). Thus, the lower temperature steam is bypassed to reduce the steam amount passing through the super heater 5, thereby elevating the outlet steam temperature of the super heater 5.

After the steam pressure has reached the desired pressure increase value $p_1$, the switching member 18*c* of the signal switcher 18 is changed over to the terminal 18*a*. Thereafter, the opening degree of the turbine bypass valve 10 is controlled, as shown in FIG. 18(*c*), in accordance with a signal obtained by proportionally integrating a pressure differential signal between the desired pressure increase value $p_1$ set in the steam pressure setter 12 and the steam pressure value actually detected by the steam pressure detector 11. Furthermore, in the case where the pressure increase accomplishment time $t_1$, the steam pressure is too high to be bypassed by the turbine bypass valve 10, the output signal from the proportional integrator 15 is increased. Therefore, such an output signal is selected by a higher level signal detector 19, to increase the opening degree of the super heater bypass valve 9, thereby bypassing the steam and suppressing an increase of the steam pressure.

Figure 1:
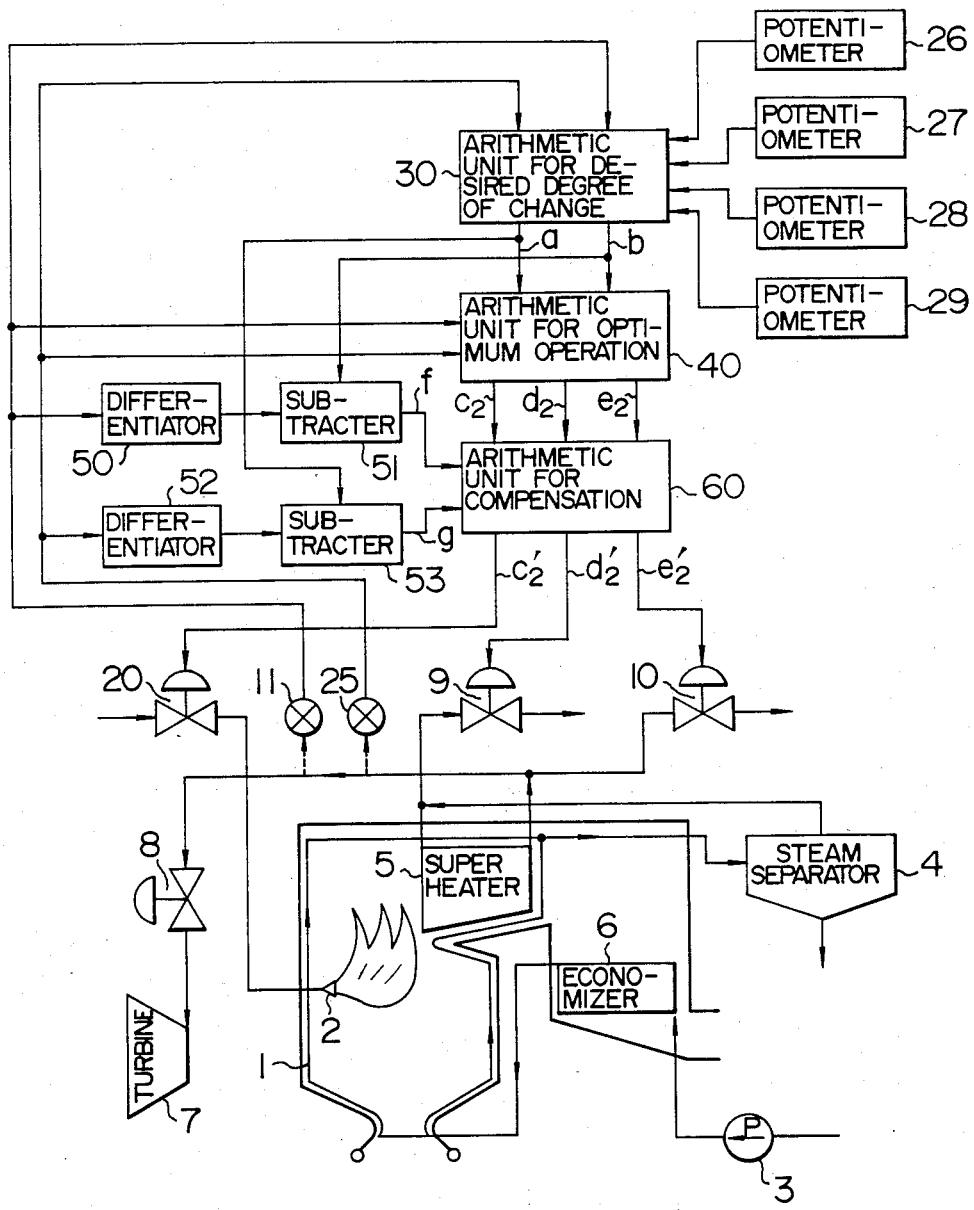
FIG. 1 is a schematic view of a boiler starting operation controlling apparatus in accordance with one embodiment of the invention.

To avoid the above noted disadvantages in connection with the above described conventional apparatus, as shown in FIG. 1, in accordance with the present invention, steam or vapor temperature detector 25 detects a temperature of steam or vapor from a super heater 5 with a desired pressure increase value setter or potentiometer 26 setting the desired pressure increase value $p_1$ shown in FIG. 18(*d*). A desired temperature increase value setter or potentiometer 27 sets an outlet steam or vapor temperature of the super heater 5 upon achieving the temperature increase, and a saturated temperature change rate limit setter or potentiometer 28 sets a saturated temperature change rate limit for suppressing a thermal stress of a greater thickness portion of a steam separator 4. A temperature increase rate limit setter or potentiometer 29 sets a temperature increase rate limit for suppressing a thermal stress of a greater thickness portion of an outlet header of the super heater 5. The respective set values set in the respective setters 26, 27, 28 and 29 and the detected values from the steam pressure detector 11 and the steam temperature detector 25 are inputted into an arithmetic unit 30 for a desired degree or rate of change of each value, which arithmetic unit, in turn, outputs a desired temperature increase degree or rate signal a and a desired pressure increase degree or rate signal b obtained through a predetermined calculation and a control on the basis of these values. The arithmetic unit 30 will be described in more detail hereinbelow with respect to its construction and operation. Incidentally, an arithmetic unit 40 for optimum operation and an arithmetic unit 60 for compensation will be described more fully hereinbelow with respect to their constructions and operations. The arithmetic unit 40 for optimum operation conducts a calculation and a control on the basis of the detected values from the steam pressure detector 11 and the steam temperature detector 25, the desired temperature increase rate signal a, the desired pressure increase rate signal by obtained by the arithmetic unit 30 and pre-memorized equations, and then outputs a command signal $c_2$ for an opening degree of the fuel flow rate regulating valve 20, a command signal $d_2$ for an opening degree of the super heater bypass valve 9 and a command signal $e_2$ for an opening degree of the turbine bypass valve 10.

The detected value from the steam pressure detector 11 is inputted into a differentiator 50 which, in turn, differentiates the detected value and calculates an actual pressure increase rate. A subtracter 51 compares the pressure increase rate calculated by the differentiator 50 with the pressure increase desired signal a and outputs a pressure increase deviation signal f which is the deviation therebetween. The detected value of the steam temperature detector 25 is inputted into a differentiator 52 which, in turn, defferentiates the detected value and calculates an actual temperature increase rate. A subtracter 53 compares the temperature increase rate obtained by the differentiator 52 with the desired temperature increase rate signal b and outputs a deviation therebetween, i.e., a temperature increase deviation signal g. The arithmetic unit 60 for compensation compensates for the respective command signal $c_2$, $d_2$ and $e_2$ on the basis of the deviation signals f and g and outputs compensated command signals $c_2'$, $d_2'$ and $e_2'$ for the degrees of opening.

The operation of the thus described embodiment will become more apparent by the following explanation of constructions and operations of the desired change rate arithmetic unit 30, the optimum operation arithmetic unit 40 and compensation arithmetic unit 60.

Figure 2:
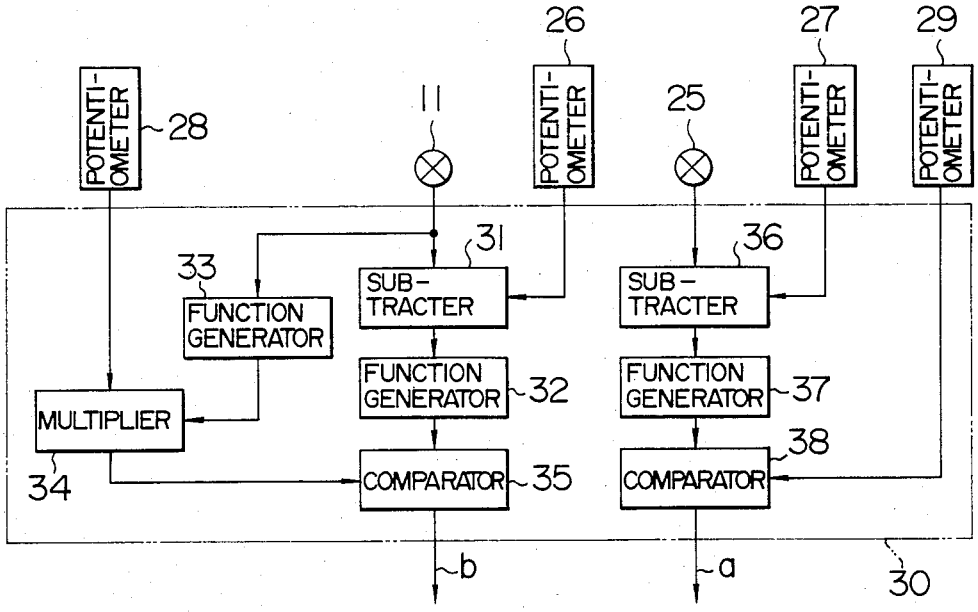
FIG. 2 is a schematic view of a desired change rate value calculating means shown in FIG. 1.
Figure 3:
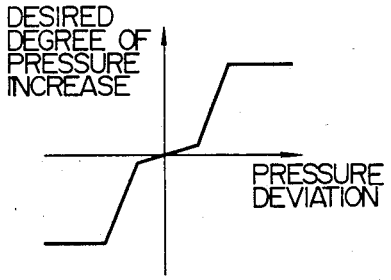
FIGS. 3, 4 and 5 are graphical illustrations of characteristics of function generators shown in FIG. 2, respectively.
Figure 4:
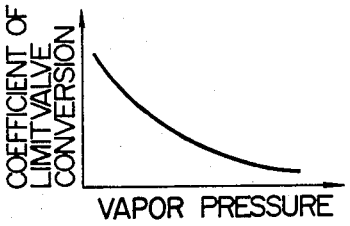
Figure 5:
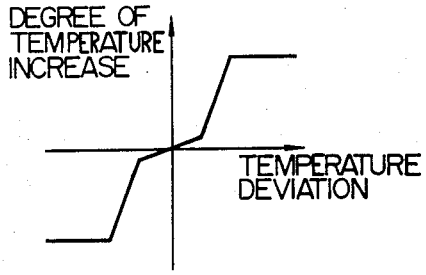

First of all, the construction of the desired change rate or degree arithmetic unit 30 will be explained in conjunction with FIG. 2, wherein a subtracter 31 calculates a difference between the detected value of the steam pressure detector 11 and the setter or potentiometer 26. A function generator 32 outputs a signal corresponding to the output signal from the subtracter 31, with the characteristics of the function generator 32 being graphically illustrated in FIG. 3. A function generator 33 outputs a signal corresponding to the detected value of the steam pressure detector 11, with the characteristics of the function generator 33 being graphically illustrated in FIG. 4. A multiplier 34 multiplies a saturated temperature change rate limit set in the setter or potentiometer 28 by the value obtained by the function generator 33. A low level selector or comparator 35 selects and outputs a lower level between the value from the multiplier 34 and the value obtained by the function generator 32. A subtracter 36 calculates a difference between the detected value of the steam temperature detector 25 and the desired temperature increase value set in the potentiometer 27. A function generator 37 outputs a signal corresponding to the output signal from the subtractor 36. A low level selector or comparator 38 selects and outputs a lower level between the value obtained by the function generator 37 and the desired temperature rate limit set in the potentiometer 29, with characteristics of the function generator 37 being graphically illustrated in FIG. 5.

The operation of desired change rate arithmetic unit 30 will now be explained. The value outputted from the subtracter 31 is a pressure deviation signal which represents a difference between the actual steam pressure and the desired pressure increase value, with the pressure deviation signal is inputted into the function generator 32 which, in turn, outputs a value corresponding to the pressure deviation signal inputted thereto. As is apparent from the characteristic curve of the function generator 32 shown in FIG. 3, if, as shown in the chart (d) of FIG. 18, the steam pressure in considerably offset from the desired pressure increase value after the ignition, the pressure deviation signal becomes greater and in correspondence with this increment, the desired basic pressure increase rate signal outputted from the function generator 32 becomes greater. In other words, in this case, the desired basic pressure increase rate which is a basic value for the desired pressure increase value is made large as much as possible whereby the pressure increase period is reduced. Inversely, if near the accomplishment of pressure increase, the steam pressure approaches the desired pressure increase value and the pressure deviation signal becomes smaller, as shown by the characteristic curve in FIG. 3, the desired basic pressure increase signal becomes smaller, thus preventing an overshoot.

The detected value of steam pressure detector 11 is inputted also into the function generator 33 which, in turn, outputs a conversion signal obtained by converting the saturated temperature change rate into the pressure change rate in correspondence with the inputted signal. In accordance with this conversion, the saturated temperature change rate limit set in the potentiometer 28 is converted into the pressure change rate limit. For better control, it is preferable to refer to the steam pressure which corresponds to the saturated temperature in one-to-one relation since a response lag or delay of control may be reduced and such reference is available in decomposition performance of the detector. A converted pressure change rate limit signal is outputted from the multiplier 34. The lower level selector or comparator 34 compares the desired basic pressure increase rate signal from the function generator 32 with the pressure change rate limit signal from the multiplier 34 and outputs its result as the desired pressure increase rate b.

The detected value of the steam temperature detector 25 is inputted into the subtracter 36 and a difference between it and the desired temperature increase value set in the potentiometer 27 is calculated. The temperature deviation signal from the subtracter 36 is inputted into the function generator 37 which, in turn, outputs the desired basic temperature increase rate value in accordance with the characteristic curve shown in FIG. 5. The above-described characteristic is such that if the temperature deviation is large, that is, in the case where the steam temperature is considerably offset from the desired temperature increase value upon the completion of the temperature increase, desired basic temperature increase rate which is a basic value for the desired temperature increase rate is made large as much as possible whereby the temperature increase period is reduced, whereas, if the steam temperature approaches the desired temperature increase value and the temperature deviation becomes smaller, the desired basic temperature increase rate is made smaller, thus preventing an overshoot. The lower level signal selector or comparator 38 compares the desired basic temperature increase rate from the function generator 37 with the temperature increse rate limit signal set in the potentiometer 29 and selects and outputs the lower level signal therebetween as the desired temperature increase signal a for safety aspect. In short, the desired change rate arithmetic unit 30 seeks optimum pressure and, temperature increase rates and in turn, outputs them as the desired pressure increase signal b and the desired temperature increase signal a, respectively.

Figure 6:
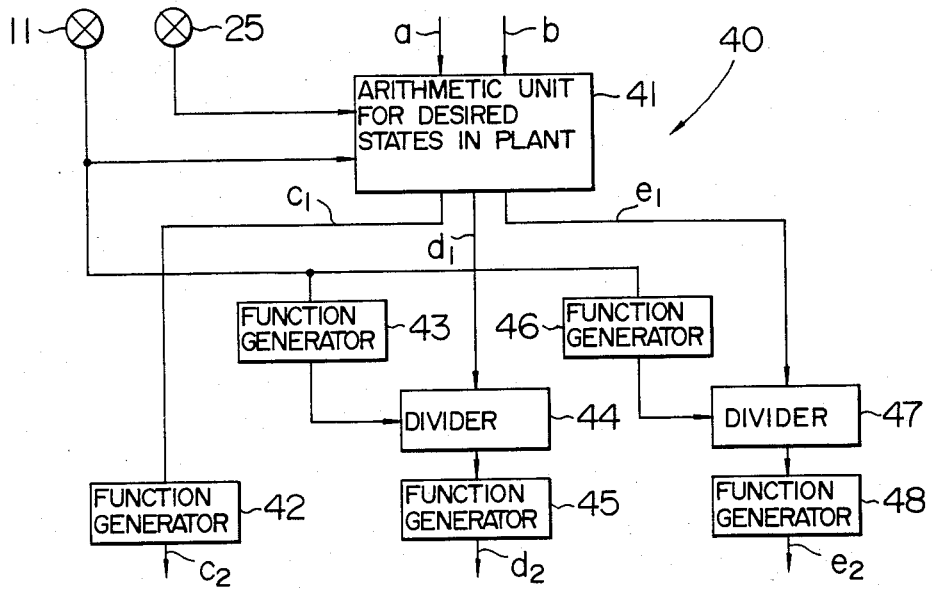
FIG. 6 is a schematic view of an optimum operational amount calculating means shown in FIG. 1.
Figure 7:
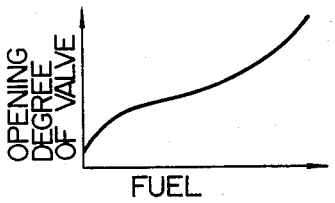
FIGS. 7, 8, 9, 10 and 11 are respective graphical illustrations of characteristics of function generators shown in FIG. 6.
Figure 8:
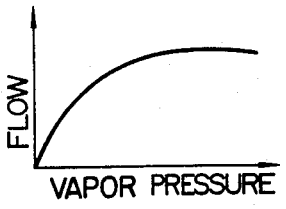
Figure 9:
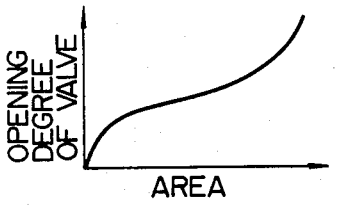
Figure 10:
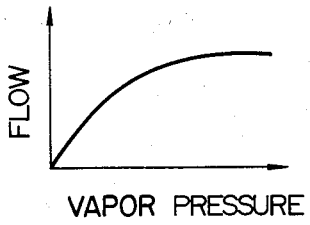
Figure 11:
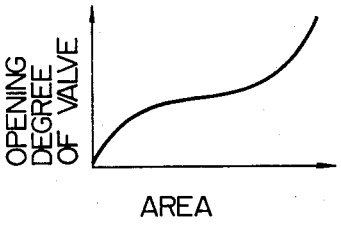

The construction of the optimum operation arithmetic unit 40 will be explained with reference to FIG. 6, wherein an arithmetic unit 41 for desired states in the plant is provided for calculating the fuel replenishment amount, the super heater bypass valve flow rate and the turbine bypass valve flow rate for determining the desired temperature and pressure increase values sought and outputted as the command signals a and b by the desired change rate arithmetic unit 30 in a given boiler state determined by the detected value of the steam pressure detector 11 and the value detected by the steam temperature detector 25. The fuel replenishment amount signal $c_1$ from the plant characteristic arithmetic unit 41 is inputted into a function generator 42 which, in turn, seeks the opening degree of the fuel flow regulating valve in accordance with the characteristic curve shown in FIG. 7. The sought opening degree is outputted as an opening degree command signal $c_2$ for the fuel flow rate regulating valve. A function generator 43 is provided with a pressure-flow characteristic of the super heater bypass valve 9 shown in FIG. 8, subjected to the detected value from the pressure detector 11 and, hence, outputs the value corresponding thereto in accordance with the characteristic curve. The super heater bypass valve flow signal $d_1$, outputted from the plant characteristic arithmetic unit 41, is inputted to a divider 44 which, in turn, divides the signal by the output signal from the function generator 43. A function generator 45 is provided with a characteristic shown in FIG. 9. The signal from the divider 44 is inputted into the function generator 45 which in turn outputs the super heater bypass valve opening degree command signal $d_2$ in accordance with the signal of the divider 44. A function generator 46 is provided with a pressure-flow characteristic of the turbine bypass valve 10 as shown in FIG. 10. The detected value from the pressure detector 11 is inputted into the function generator 46 which, in turn, outputs the value corresponding to the inputted detected value in accordance with the characteristic. The turbine bypass valve flow signal $e_1$ outputted from the plant characteristic arithmetic unit 41 is inputted into a divider 47 which, in turn, divides the inputted value by the output signal from the function generator 46. A function generator 48 is provided with a characteristic shown in FIG. 11. The signal of the divider 47 is inputted into the function generator 48 which in turn outputs the turbine bypass valve opening degree command signal $e_2$.

Prior to an explanation of the operation of the optimum operation arithmetic unit 40, a calculation of the plant characteristic arithmetic unit 41 will be explained. First of all, the symbols used in the calculation are defined as follows:

A is the heat transfer area ($m^2$) of the super heater 5;

$G_{ww}$ is the feed water flow (kg/s) to the water wall 1;

$G_e$ is the amount of evaporation (kg/s) in the water wall 1;

h'(P) is the enthalpy (kcal/kg) of the saturated water, (the function of P);

h''(P) is the enthalpy (kcal/kg) of the saturated steam (function of P);

H(P, T) is the enthalpy (kcal/kg) of the output steam of the super heater 5 (function of P and T);

$\dot{H}$ is the change rate of the output steam enthalpy (kcal/kg s) of the super heater 5;

Hi is the enthalpy (kcal/kg) of the inlet steam of the super heater 5;

$H_{ww}$ is the enthalpy (kcal/kg) of the outlet fluid of the water wall 1;

$H_{ECO}$ is the outlet feed water enthalpy (kcal/kg) of the economizer;

$\dot{P}$ is the steam pressure (kg/cm²abs);

P is the steam pressure change rate (kg/cm² s);

Q(x) is the thermal absorptivity (kcal/s) of the water wall 1 (function of x);

T is the outlet steam temperature (°C.) of the super heater 5;

$\dot{T}$ is the outlet steam temperature change rate (°C./s) of the super heater 5;

v(P, T) is the average specific volume ($m^3$/kg) of the steam in the super heater 5;

V is the volume ($m^3$) of the interior of the super heater 5;

x is the fuel replenishment rate (kg/s);

$x_{min}$ is the lower limit of the fuel replenishment rate (kg/s);

y is the steam flow rate (kg/s) of the turbine bypass valve 10;

$y_{min}$ is the minimum steam flow rate (kg/s) of the turbine bypass valve 10;

z is the steam flow rate (kg/s) of the super heater bypass valve 9;

$\alpha$ is the average heat transmission (kcal/m²s°C.) of the super heater 5;

$T_H(x)$ is the inlet combustion gas temperature (°C.) of the super heater 5 (function of x); and $(\partial T/\partial H)_{P,T}$ is the partial differential coefficient of the steam temperature with respect to the enthalpy (function of P and T).

Among the above-described values, the heat transfer area A and the volume V of the super heater 5 are determined by the structure of the boiler and the feed water flow Gww to the water wall 1, the fuel replenishment rate lower limit $x_{min}$ and the minimum steam flow rate $y_{min}$ of the turbine bypass valve 10 are determined by its design. The steam pressure P and steam temperature T are detected by the steam pressure detector 11 and steam temperature detector 25, respectively. The steam pressure change rate $\dot{P}$ and the steam temperature change rate $\dot{T}$ are given by the output signals a and b from the desired change rate arithmetic unit 30. Further, the saturated water enthalpy h'(P), the saturated steam enthalpy h''(P), the outlet steam enthalpy H(P, T) of the super heater 5, the average specific volume v(P, T) of the steam in the super heater 5, and the partial differential coefficient $(\partial T/\partial H)_{P,T}$ may be sought by using the Mollier Chart on the basis of the steam pressure P and the steam temperature T.

The following equations are established with respect to the heat transfer of the super heater 5.

$$\dot{T} = \left(\frac{\partial T}{\partial H}\right)_{P,T} \cdot \dot{H} \tag{1}$$

$$\frac{v}{v(P,T)}\dot{H} = y\{H_i - H(P,T)\} + A \cdot \alpha\{T_H(x) - T\} \tag{2}$$

In the embodiment of the present invention, since the super heater bypass valve 9 is connected to the outlet of the steam separator 4, the inlet steam enthalpy Hi of the super heater 5 is given by:

$$Hi = h'(P) \tag{3}$$

Incidentally, if the super heater bypass valve 9 is connected to a midportion of the super heater 5, the temperature at the midportion is detected and the enthalpy therefor may be sought by using the Mollier Chart on the basis of the detected temperature and the steam pressure P. More strictly speaking, the average heat transmission $\alpha$ of the super heater 5 is the function of the combustion gas temperature and the combustion gas amount both of which in turn are the functions of the fuel replenishment x. Therefore, if necessary, the above-described average heat transmission $\alpha$ may be given as the function of the actually measured fuel replenishment.

From the equations (1), (2) and (3), the following equation may be obtained:

$$\dot{T} = \left\{\frac{v(P,T)}{V} \cdot \left(\frac{\partial T}{\partial H}\right)_{P,T}\right\} [\{h'(P) - H(P,T)\}y + A \cdot \alpha \cdot T_H(x) - A \cdot \alpha \cdot T] \tag{4}$$

The equation (4) is rewritten as follows:

$$\dot{T} = -K_1 \cdot y + K_2 \cdot T_H(s) - K_3 \tag{5}$$

where $K_1$, $K_2$ and $K_3$ are model parameters which are defined as follows:

$$K_1 = \left\{\frac{v(P,T)}{V} \cdot \left(\frac{\partial T}{\partial H}\right)_{P,T}\right\} \cdot \{H(P,T) - h'(P)\} \tag{6}$$

$$K_2 = \left\{\frac{v(P,T)}{V} \cdot \left(\frac{\partial T}{\partial H}\right)_{P,T}\right\} A \cdot \alpha \tag{7}$$

$$K_3 = \left\{\frac{v(P,T)}{V} \cdot \left(\frac{\partial T}{\partial H}\right)_{P,T}\right\} A \cdot \alpha \cdot T \tag{8}$$

On the other hand, the following equations are established with respect to the heat transfer in the water wall 1 and steam pressure.

$$V\dot{P} = Ge - y - z \tag{9}$$

$$Ge = Gww\frac{Hww - h'(P)}{h''(P) - h'(P)} \tag{10}$$

$$Hww = H_{ECO} + \frac{Q(x)}{Gww} \tag{11}$$

Incidentally, although the outlet feed water enthalpy $H_{ECO}$ of the economizer 6 is kept substantially constant in the starting operation, if necessary, a temperature of feed water at the outlet of the economizer 6 is actually measured and the more exact value may be obtained by using the Mollier Chart on the basis of the measured temperature and the steam pressure P.

From the equations (9), (10) and (11), the following equation is given:

$$\dot{P} = \frac{1}{V}\left[-y - z + \frac{Q(x)}{h''(P) - h'(P)} + \frac{\{GwwH_{ECO} - h'(P)\}}{h''(P) - h'(P)}\right] \tag{12}$$

The equation (12) is rewritten as follows:

$$\dot{P} = K_4(y-z) + K_5 \cdot Q(x) - K_6 \tag{13}$$

where $K_4$, $K_5$ and $K_6$ are model parameters which are defined as follows:

$$K_4 = 1/V \tag{14}$$

$$K_5 = \frac{1}{V\,h''(P) - h'(P)} \tag{15}$$

$$K_6 = \frac{Gww\{h'(P) - H_{ECO}\}}{V\{h''(P) - h'(P)\}} \tag{16}$$

From the equation (13), $$z = (1/K_4)\{K_5 \cdot Q(x) - \dot{P} - K_6\} - y \tag{17}$$

The steam flow rate z of the super heater bypass valve 9 has the following inherent property:

$$z \geqq 0 \tag{18}$$

Therefore, substituting the equation (17) into the relation (18), $$\dot{P} \leqq -K_4 \cdot y + K_5 \cdot Q(x) - K_6 \tag{19}$$

From the above, the function of the plant characteristic arithmetic unit 41 is to solve a problem of the mathematical programming as follows:

$$\begin{cases} \dot{T} = -K_1 \cdot y + K_2 \cdot T_H(x) - K_3 & (5) \\ \dot{P} \leqq -K_4 \cdot y + K_5 \cdot Q(x) - K_6 & (19) \\ x \geqq x_{min} & (20) \\ y \geqq y_{min} & (21) \end{cases}$$

Namely, the minimum value x which satisfies the conditions of the above equations is solved and with respect to the minimum value x, the values y and z are sought from the conditions (5) and (17). The solutions of this problem are graphically represented in FIG. 12.

Figure 12:
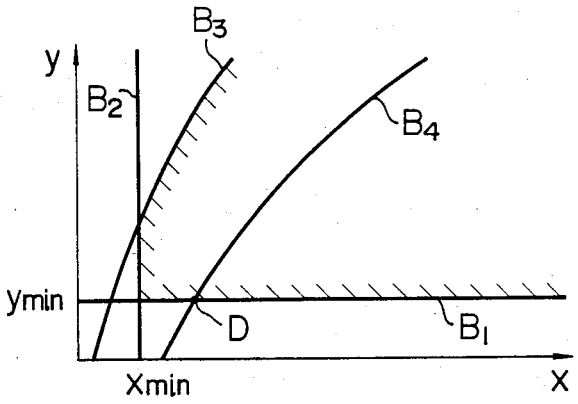
FIG. 12 is a graphical illustration of a solution of a calculation of a plant characteristics arithmetic unit shown in FIG. 6.

In FIG. 12, the abscissa of the graph denotes the fuel replenishment x and the ordinate thereof denotes the steam flow rate y of the turbine bypass valve 10, with the line $B_1$ denoting the minimum value $y_{min}$ of the steam flow rate of the turbine bypass valve 10 and the line $B_2$ denoting the lower limit of the fuel replenishment. The curve $B_3$ corresponds to the rewritten equation derived from the relation (19), that is;

$$y = \frac{K_5}{K_4}Q(x) - \frac{\dot{P} + K_6}{K_4}$$

Also, the curve $B_4$ is the rewritten equation derived from the equation (5), that is:

$$y = \frac{K_2}{K_1} \cdot T_H(x) - \frac{\dot{T} + K_3}{K_1}$$

The set of solutions meeting the above-described conditions are present on the curve $B_4$ within the hatched region defined by the curve $B_3$ and the lines $B_1$ and $B_2$. In this case, the optimum solution is designated by the point D.

Figure 13:
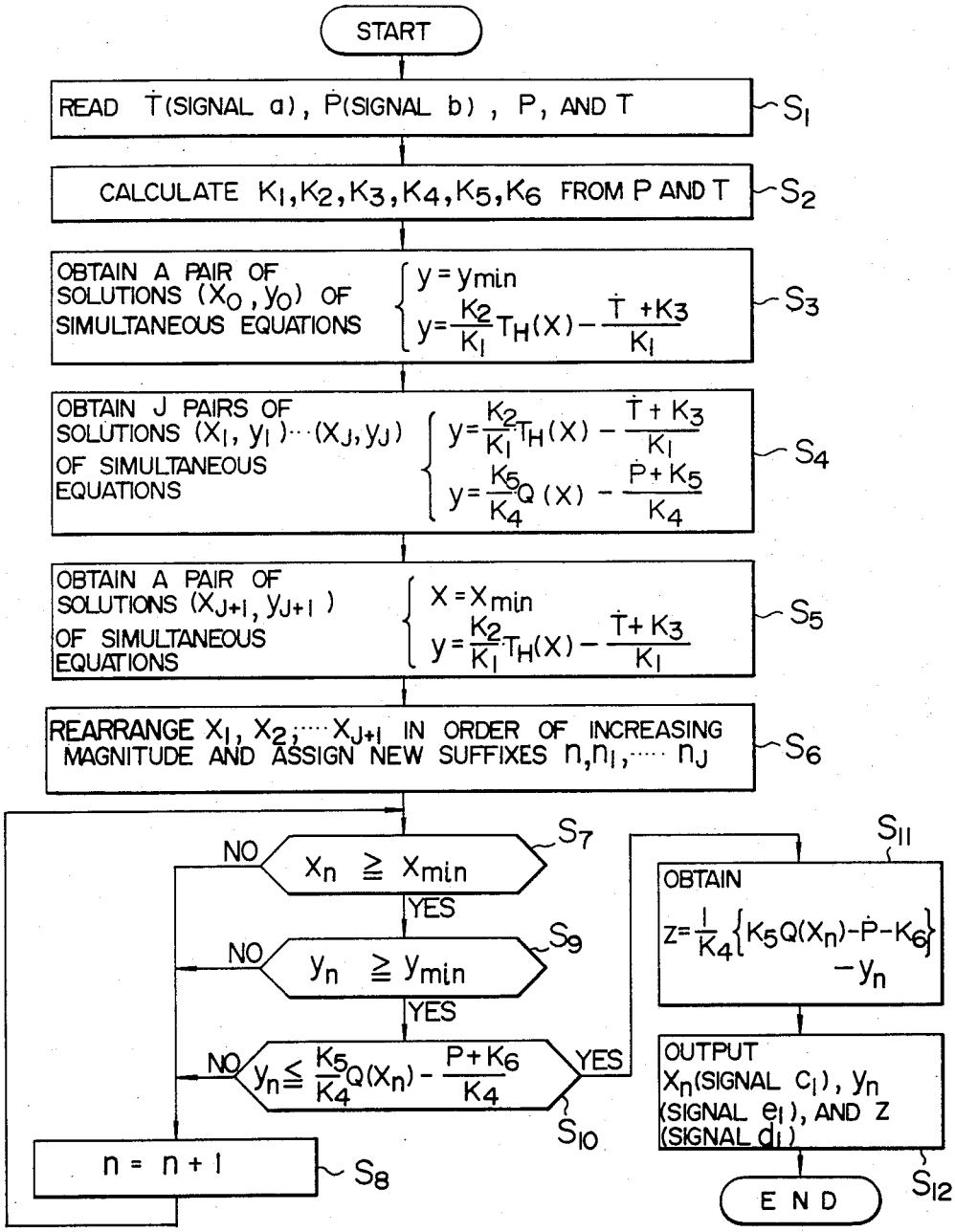
FIG. 13 is a flowchart illustrating an operation of a plant characteristic arithmetic unit shown in FIG. 6.

Thus, the explanation of the calculation in the plant characteristic arithmetic unit 41 has been completed. Subsequently, the operation of the optimum operation arithmetic unit 40 will be explained with reference to the flowchart shown in FIG. 13. From the fact that $T_H(x)$ is a monotone increasing function of upward convex and Q(x) is a monotone increasing function having only one point of inflection (at which the secondary differential coefficient becomes zero), the calculation of the plant characteristic arithmetic unit 41 is conducted in order shown in FIG. 13 to thereby obtain the optimum solution. First of all, there are inputted the steam temperature change rate $\dot{T}$, the steam pressure change rate $\dot{P}$ obtained by the desired change rate arithmetic unit 30, the value P detected by the steam pressure detector 11, and the value T detected by the steam temperature detector 25 (step $S_1$). Subsequently, based upon the values P and T, the parameters $K_1$, $K_2$, $K_3$, $K_4$, $K_5$, and $K_6$ are calculated out of the equations (6), (7), (8), (14), (15) and (16) (step $S_2$). By using these parameters, the solution ($x_0$, $y_0$) of the following simultaneous equations is obtained (step $S_3$).

$$\begin{cases} y = y_{min} \\ y = \frac{K_2}{K_1} \cdot T_H(x) - \frac{\dot{T} + K_3}{K_1} \end{cases}$$

Subsequently, the j pairs of solutions ($x_1$, $y_1$), ($x_2$, $y_2$) . . . ($x_j$, $y_j$) of the following simultaneous equations are obtained (step $S_4$).

$$\begin{cases} y = \frac{K_2}{K_1} \cdot T_H(x) - \frac{\dot{T} + K_3}{K_1} \\ y = \frac{K_5}{K_4} \cdot Q(x) - \frac{\dot{P} + K_5}{K_4} \end{cases}$$

Further, a pair of solution ($x_{j+1}$, $y_{j+1}$) of the following simultaneous equations are sought (step $S_5$).

$$\begin{cases} x = x_{min} \\ y = \dfrac{K_2}{K_1} \cdot T_H(x) - \dfrac{\dot{T} + K_3}{K_1} \end{cases}$$

When the solutions are given through the above-described steps, the solutions $x_1, x_2, \ldots, x_j$ and $x_{j+1}$ are rearranged in order of increasing magnitude, the minimum one is picked up and the minimum solution is assigned with suffix n to provide the new value $x_n$ (step $S_6$). The picked-up value $x_n$ is to be compared as to whether $x_n$ is equal to or more than $x_{min}$ or not (step $S_7$). When the value $x_n$ is less than $x_{min}$, the next greater value than the value $x_n$ picked up in the step $S_6$ from the values $x_1, x_2, \ldots, x_j$ and $x_{j+1}$ is picked up and assigned as a new value $x_n$ (step $S_8$). The new value $x_n$ picked up in the step $S_8$ is again compared with the value $x_{min}$ (step $S_7$). Thus, the operations of the steps $S_7$ and $S_8$ are repeated until the value $x_n$ exceeds the minimum value $x_{min}$. When the minimum value $x_n$ exceeding the value $x_{min}$ is obtained in the step $S_7$, a value y corresponding to the above-described minimum value $x_n$ is the obtained solutions, that is, the value $y_n$ is picked up, and the value $y_n$ is compared with the value $y_{min}$ (step $S_9$). If the value $y_n$ is less than the value $y_{min}$, the step is returned again to the step $S_8$, and then, the next greater value than the above-described minimum value $x_n$ is picked up. The new value is assigned as the value $x_n$ and the steps $S_7$ and $S_9$ are repeated. Thus, finally, the value $x_n$ which is the smallest value x of the solutions equal to or greater than the values $x_{min}$ and $y_{min}$, and the value $y_n$ associated with the value $x_n$ are obtained. Then, the solution $(x_n, y_n)$ is judged whether or not the solution meets the following relation (step $S_{10}$).

$$y_n \leqq \frac{K_5}{K_4} \cdot Q(x_n) - \frac{\dot{P} + K_6}{K_4}$$

In the step $S_{10}$, in the case where the above relation is not satisfied, returning back to the step $S_8$, the steps $S_7$, $S_9$ and $S_{10}$ are repeated. Then, when the above relation is met in the step $S_{10}$, the calculation is advanced to the step $S_{11}$ and the following equation is calculated.

$$z = (1/K_4)\{K_5 \cdot Q(x_n) - \dot{P} - K_6\} - y_n$$

By the calculation, the optimum fuel replenishment $x_n$, the steam flow rate $y_n$ of the turbine bypass valve 10 and the steam flow rate z of the super heater bypass valve 9 are obtained. Signals $c_1$, $d_1$ and $e_1$ each corresponding to the values $x_n$, z and $y_n$ are outputted from the plant characteristic arithmetic unit 41.

Referring back to FIG. 6, the fuel replenishment signal $c_1$ is inputted into the function generator 42 which in turn outputs an opening degree command value of the fuel flow rate regulating valve 20. In this case, since it is safe to say that in the fuel flow rate regulating valve 20, a pressure difference between pressures upsteam and downstream of the regulating valve 20 is kept constant, an opening degree command signal $c_2$ for the fuel flow rate regulating valve 20 may be obtained by inputting the fuel replenishment signal $c_1$ directly into the function generator 42. On the other hand, since the valve inlet pressures of the super heater bypass valve 9 and the turbine bypass valve 10 are varied in accordance with the pressure increases, it is necessary to convert the degree of the valves 9 and 10 in view of these variations. For this reason, the pressure-flow characteristics of the respective valves 9 and 10 are once obtained and then the opening degrees of the respective valves 9 and 10 are determined. Namely, the steam pressure detected by the steam pressure detector 11 is inputted into the function generator 43, so that the inputted value is converted into a flow rate corresponding to its magnitude in accordance with the characteristic shown in FIG. 8. Therefore, the steam flow rate of the super heater bypass valve 9 obtained by the plant characteristic arithmetic unit 41 is divided by the flow rate converted by the divider 44. Thus, a port area value, necessary for the super heater bypass valve 9, is outputted from the divider 44. The area value is inputted into the function generator 45 which, in turn, outputs, in accordance with the characteristic shown in FIG. 9, the opening degree command signal $d_2$ of the super heater bypass valve 9 needed to obtain the actual port area. In the same manner, the flow rate corresponding to the steam pressure is outputted from the function generator 46 in accordance with the characteristic shown in FIG. 10. In the divider 47, the turbine bypass valve flow rate signal $e_1$, outputted from the plant characteristic arithmetic unit 41, is divided by the above-described flow rate. The obtained port area value needed for the turbine bypass valve 10 is inputted into the function generator 48 which in turn outputs the opening degree command signal $e_2$ of the turbine bypass valve 10 needed for obtaining the port area, in accordance with characteristic shown in FIG. 11. Incidentally, by using the calculation result of such optimum operation arithmetic unit 40, it is possible to output an alarm signal for an abnormal state and to obtain history data for prediction of possible service life.

Finally, the construction and operation of compensation arithmetic unit 60 will now be explained with reference to a FIG. 14 and a characteristic curve shown in FIG. 15. In the compensation arithmetic unit 60, the opening degree command signal $c_2$ of the fuel flow rate regulator, the opening degree command signal $d_2$ of the super heater bypass valve 9 and the opening degree command signal $e_2$ of the turbine bypass valve 10 which are obtained in the optimum operation arithmetic unit 40 are compensated to the opening degree command signals $c_2'$, $d_2'$ and $e_2'$ which are suitable for the actual opening degrees of the valves 20, 9 and 10, respectively. The compensation is effected by the pressure increase rate deviation signal f and the temperature increase rate deviation signal g based upon the actual pressure and temperature of steam detected by the steam pressure detector 11 and the steam temperature detector 25.

The pressure increase rate deviation signal f and the temperature increase rate deviation signal g are obtained by the aforesaid differentiators 50 and 52 and subtracters 51 and 53 shown in FIG. 1. Namely, the detected value of the steam pressure detector 11 is inputted into the differentiator 50 which, in turn, outputs the actual pressure increase rate signal. This pressure increase rate signal and the desired pressure increase rate signal b from the desired change rate arithmetic unit 30 are inputted into the subtracter 51 which in turn outputs the pressure increase rate deviation signal f which is a difference signal therebetween. In the same manner, the steam temperature detected by the steam temperature detector 25 is inputted into the differentiator 52 which, in turn, outputs the actual temperature increase rate signal, and the latter signal and the desired temperature increase rate signal a from the desired change rate arithmetic unit 30 are inputted into the subtracter 53 which, in turn, outputs the temperature increase rate deviation signal g which is a difference signal therebetween.

Figure 14:
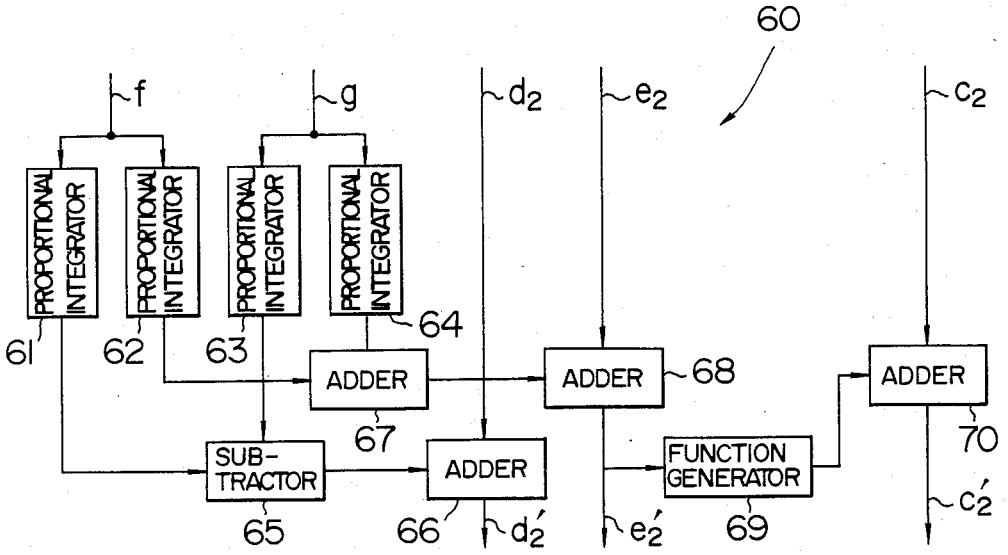
FIG. 14 is a schematic view of a compensation calculating or arithmetic unit shown in FIG. 1.
Figure 15:
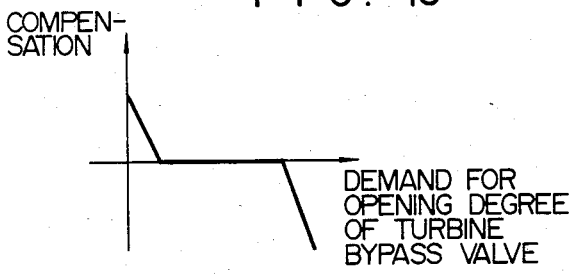
FIG. 15 is a graph showing a characteristic of the function generator shown in FIG. 14.

As shown in FIG. 14, the pressure increase rate deviation signal f is inputted into the proportional integrators 61 and 62 which in turn output their proportionally integrated values. The temperature increase rate deviation signal g is inputted into the proportional integrators 63 and 64 which in turn output their proportionally integrated values. The signals from the proportional integrators 61 and 63 are inputted into the subtracter 65 which in turn outputs a difference therebetween. By an adder 66, the opening degree command signal $d_2$ of the super heater bypass valve 9 is compensated by the signal from the subtracter 65. The signals of the proportional integrators 62 and 64 are added by an adder 67. By an adder 68, the opening degree command signal $e_2$ of the turbine bypass valve 10 is compensated by the signal from the adder 67. A function generator 69 is provided with a characteristic shown in FIG. 15. The signal from the adder 68 is inputted into the function generator 69 which, in turn, outputs a signal corresponding thereto. As adder 70 compensates the opening degree command signal $c_2$ of the fuel flow rate regulating valve 20 by the signal of the function generator 69.

The operation of the above-described compensation arithmetic unit 60 will be explained. As is apparent from the foregoing description, any of the opening degree command signals $c_2$, $d_2$ and $e_2$ obtained by the optimum operation arithmetic unit 40 is obtained by simulating the plant characteristic. Even if the actual plant would be operated by using such opening degree command signals $c_2$, $d_2$ and $e_2$, there would be a fear of deviation in initial operation. Therefore, in the compensation arithmetic unit 60, the calculated desired temperature and pressure increase rates and the deviation signals f and g from the actual temperature and pressure increase rates are inputted thereinto and the opening degree command signals $c_2$, $d_2$ and $e_2$ are compensated in order to reduce the deviation.

By the way, in general, if the turbine bypass valve 10 is opened, both the temperature and pressure increase rates are decreased but if the super heater bypass valve 9 is opened, the temperature increase rate is increased while the pressure increase rate is decreased. This shows that in the case where the temperature increase rate deviation signal g and the pressure increase rate deviation signal f are intended to be reduced, if one valve is corrected by one deviation signal, that is, if for example, the opening degree of the super heater bypass valve 9 is compensated by the temperature increase rate deviation signal g, whereas, the opening degree of the turbine bypass valve 10 is compensated by the pressure increase rate deviation signal f, one compensation will necessarily effect the other compensation as a disturbance. In order to reduce or suppress such disturbance as much as possible, if the reduction of the temperature increase rate is desired, it is necessary to keep the total steam flow rate at constant to avoid imparting the outside turbulence to the pressure increase rate by closing the super heater bypass valve 9 while opening the turbine bypass valve 10, or otherwise if the reduction of the pressure increase rate is desired, it is necessary to compensate for the reduction of the temperature increase rate due to the disturbance by opening the turbine bypass valve 10 and the super heater bypass valve 9 simultaneously. In view of such phenomenon, the compensation arithmetic unit 60 is constructed as shown in FIG. 14.

In FIG. 14, the compensation for the opening degree command signal $d_2$ of the super heater bypass valve 9 is conducted in the following manner. Namely, the compensation signal based upon the pressure increase rate deviation signal f outputted from the proportional integrator 61 and the compensation signal based upon the temperature increase rate deviation signal g outputted from the proportional integrator 63 are inputted into the subtracter 65, and for the above-described reason, the latter compensation is subtracted from the former compensation, thereby obtaining the compensation signal for the opening degree of the super heater bypass valve 9. The compensation signal from the subtracter 65 is added to the opening signal command signal $d_2$ in the adder 66 which, in turn, outputs the corrected opening degree command signal $d_2'$ for the super heater bypass valve 9. Also, the compensation of the opening degree command signal $e_2$ of the turbine bypass valve 10 is carried out in the following manner. Namely, the compensation signal based upon the pressure increase rate deviation signal f outputted from the proportional integrator 62 and the compensation signal based upon the pressure increase rate deviation signal g outputted from the proportional integrator 64 are inputted into the adder 67. For the above-described reason, both the compensations are added to thereby obtain the opening degree compensation signal for the turbine bypass valve 10. The compensation signal from the adder 67 is added to the opening degree command signal $e_2$ in the adder 68 which, in turn, outputs the corrected opening degree command signal $e_2'$ for the turbine bypass valve 10.

Subsequently, the compensation for the opening degree command signal $c_2$ of the fuel flow regulating valve 20 will be described. In case of the compensation for the opening degree command signals $d_2$ and $e_2$ of the super heater bypass valve 9 and the turbine bypass valve 10 as described above, if the fuel replenishment is also simultaneously compensated for, there is a fear that the compensation operations would interfere with each other. In order to such interference, basically, the opening degree command signal $c_2$, obtained by the optimum operation arithmetic unit 40, is used without any modification but only when the opening degree of the turbine bypass valve 10 becomes extremely large or small, the fuel replenishment is reduced or increased. Such operation is determined in accordance with the characteristic of the function generator 69 shown in FIG. 15. The actual opening degree command signal $e_2'$ of the turbine bypass valve 10 is inputted into the function generator 69 which in turn outputs the compensation signal only when the signal $e_2'$ is extremely large of extremely small. The compensation signal is added to the opening degree command signal $c_2$ in the adder 70, thereby obtaining the corrected opening degree command signal $c_2'$ of the fuel flow rate regulating valve 20.

Thus, the opening degree command signals $c_2'$, $d_2'$ and $e_2'$ obtained, by the compensation arithmetic unit 60, are outputted as opening commands for actually operating the fuel flow rate regulating valve 20, the super heater bypass valve 9 and the turbine bypass valve 10, respectively.

Finally, the operation of the present embodiment will be summarized in conjunction with FIG. 1 as follows. First of all, the values set in the setters or potentiometers 26, 27, 28, and 29 as well as the actually measured steam pressure and temperature detected by the steam pressure and temperature detectors 11 and 25 are inputted into the desired change rate or degree arithmetic unit 30. The desired pressure increase rate signal b is calculated in and outputted from the arithmetic unit 30 on the basis of the steam pressure, the desired pressure increase rate set in the potentiometer 26 and the saturated temperature change rate limit set in the potentiometer 28 (in view of the thermal stress of the steam separator 4 having a greater thickness). Also, the desired temperature increase rate signal a is calculated in and outputted from the arithmetic unit 30 on the basis of the steam temperature, the desired temperature increase rate set in the potentiometer 27 and the temperature increase limit set in the potentiometer 29 (in view of the thermal stress of the super heater outlet header having a greater thickness).

Inputted into the optimum operation arithmetic unit 40 are the desired temperature increase rate signal a, the desired pressure increase rate signal b, and the actually measured steam pressure and temperature by which obtained are predetermined numerical expressions on the basis of the plant characteristics. By solving such numerical expressions, the thermal stress at the thicker portions are suppressed and the starting operation is accomplished in a short period of time. At the same time, the optimum fuel replenishment, the super heater bypass valve steam flow rate and the turbine bypass valve steam flow rate are determined so as to reduce the starting loss. These values are converted into the opening degree of the fuel flow regulating valve 20, the opening degree of the super heater bypass valve 9 and the opening degree of the turbine bypass valve 10, respectively. Corresponding thereto, the arithmetic unit 40 outputs the opening degree command signals $c_2$, $d_2$ and $e_2$.

The differentiators 50 and 52 output, respectively, the change rates or degrees of the steam pressure and temperature detected by the steam pressure detector 11 and the steam temperature detector 25, that is, the actual pressure and temperature increase rates. These pressure and temperature increase rates are compared with the calculated desired pressure and temperature increase rate signals b and a by the subtracters 51 and 53 which in turn output the pressure and temperature increase rate deviation signals f and g which are differences therebetween, respectively.

The compensation arithmatic unit 60 compensates, without any outside turbulence, for the opening degree command signals $c_2$, $d_2$ and $e_2$ outputted from the optimum operation arithmetic unit 40 on the basis of the above described pressure and temperature increase rate deviation signals f and g and outputs the compensated opening degree command signals $c_2'$, $d_2'$ and $e_2'$. In accordance with these opening degree command signals $c_2'$, $d_2'$ and $e_2'$, the fuel flow rate regulating valve 20, the super heater bypass valve 9 and the turbine bypass valve 10 are operated for attaining their purposes, respectively.

As described above, in accordance with the embodiment, calculated are the desired steam pressure and temperature values on the basis of the steam pressure, the steam temperature and the values set in the potentiometers such as the desired pressure increase, the desired temperature increase, the saturated temperature change rate limit and the temperature increase rate limit. Then, the optimum opening degree command signals for the fuel flow rate regulating valve, the super heater bypass valve and the turbine bypass valve are calculated on the basis of the desired steam pressure and temperature values, thereby operating the opening degrees of these valves with compensations for the respective opening degree command signals. Accordingly, in the starting operation of the boiler, it is possible to accomplish the starting operation for a short period of time and to reduce the starting loss while suppressing the generation of thermal stress in the steam separator or the super heater outlet header.

Figure 16:
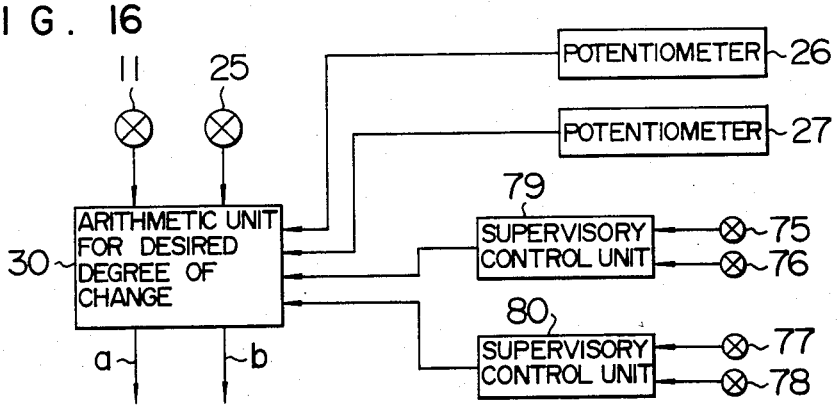
FIG. 16 is a schematic view of a portion of a boiler starting operation controlling apparatus in accordance with another embodiment of the invention.

FIG. 16 provides an example of another embodiment of the present invention, which comprises a desired pressure increase setter or potentiometer 26, a desired temperature increase setter or potentiometer 27, and a desired change rate or degree arithmetic unit 30 which are the same as those shown in FIG. 1. Inner and outer temperatures of the separator 4 are detected by temperature detectors 75 and 76, respectively. Reference numeral 79 denotes a supervisory control unit for the thermal stress in the steam separator and 80 denotes a supervisory control unit for the thermal stress in the super heater outlet header. The difference between the first described embodiment of the present invention and the embodiment of FIG. 16 resides in the fact that, in the first embodiment, the saturated temperature change rate limit and the temperature increase rate limit are set in the potentiometers 28 and 29 and inputted into the arithmetic unit 30 for desired degrees of change, whereas, in the second embodiment of FIG. 16, the saturated temperature change rate limit and the temperature increase rate limit are inputted into the arithmetic unit 30 for desired degrees of change by another means. Except for this point, the operation of the second embodiment of FIG. 16 is the same as that of the first described embodiment of the present invention.

The inner and outer metal temperatures, detected by the temperature detectors 75 and 76, of the steam separator 4 are inputted into the supervisory control unit 79. The latter unit 79 always calculates the thermal stress generated in the greater thickness portion of the steam separator 4 on the basis of the detected temperatures and outputs a suitable saturated temperature change rate limit in accordance with the generated thermal stress. In the same manner, the inner and outer metal temperatures, detected by the temperature detectors 77 and 78, of the super heater outlet header are inputted into the supervisory control unit 80 which, in turn, always calculates the thermal stress generated in the greater thickness portion of the super heater outlet header on the basis of these temperatures and outputs a suitable temperature increase limit in accordance with the generated thermal stress.

Thus, in accordance with the second embodiment of FIG. 16, the temperature detectors for detecting the inner and outer metal temperatures of the greater thickness portion of the steam separator and the supervisory control unit for the thermal stress of the steam separator and used instead of the saturated temperature change rate limit setter or potentiometer used in the first described embodiment of the present invention, and the temperature detectors for detecting the inner and outer metal temperatures of the greater thickness portion of the super heater outlet header and the supervisory control unit for the thermal stress of the super heater outlet header are used instead of the temperature increase rate limit setter or potentiometer used in the first embodiment of the present invention. Therefore, in accordance with the second embodiment of FIG. 16, not only the same effect as that of the first embodiment may be obtained but also, in the case where the thermal stress is small, it is possible to perform a more rapid starting operation and in the case where the thermal stress is abnormally high, it is possible to obtain the saturated temperature change rate limit and the temperature increase rate limit by which the temperature and pressure increase are made moderate.

As described above, in accordance with the present invention, the desired temperature and pressure increase rates are calculated on the basis of the detected steam pressure and temperature, the desired pressure and temperature, the saturated temperature change rate limit and the temperature increase rate limit, the opening degrees of the valve for controlling the fuel flow, the valve for bypassing the steam from the super heater and the valve for bypassing the steam from the super heater to the portion other than its primary supply component are calculated on the basis of the desired values and the steam pressure and temperature, and further, the opening degrees are suitably compensated for. Accordingly, it is possible to perform the boiler starting operation in a short period of time and to reduce the starting loss while suppressing the generation of the thermal stress in the greater thickness portions of the boiler.

What is claimed is:

1. An apparatus for controlling a starting operation of a boiler, the apparatus comprising:

a super heater means and a steam separator means;

a first valve means for bypassing steam of said super heater means;

a second valve means for bypassing steam from said super heater means to a portion other than a primary supply portion to be supplied with steam from said super heater means;

a third valve means for regulating a fuel flow to be supplied to a burner means;

a temperature detecting means for detecting a pressure of steam at a predetermined portion of the boiler;

pressure detecting means for detecting a pressure of steam in the boiler;

first arithmetic means for calculating a desired steam temperature change rate value represented by a preset constant or function of a signal with respect to thermal stress of a super heater outlet header and a desired steam pressure change rate value which is given by a preset constant or function of a signal representing thermal stress of said steam separator which are required for suppressing stresses to be generated in predetermined structural portions of the boiler, on the basis of said steam temperature, said steam pressure, a desired pressure increase value, and a desired temperature increase value; and second arithmetic means for calculating manipulated variables of said first valve means, said second valve means and said third valve means, respectively, in dependence upon said steam temperature, said steam pressure, said desired steam temperature change rate value and said desired steam pressure change rate value obtained by said first arithmetic means.

2. An apparatus for controlling a starting operation of a boiler according to claim 1, wherein said arithmetic means calculates the manipulated variables of said first, second and third valve means so as to minimize a fuel flow through said third valve means.

3. An apparatus for controlling a starting operation of a boiler according to claim 1, wherein said first arithmetic means includes one subarithmetic means in which said desired steam pressure change rate value is set to be "zero" when said steam pressure equals said desired pressure increase value, and in which said desired steam pressure change rate value, upon a difference between said desired pressure and said steam pressure is small, is set to be at a level lower than that corresponding to a situation wherein the difference is large, and wherein said first arithmetic means further includes another subarithmetic means in which said desired steam temperature change rate value is set to be "zero" when said steam temperature equals to said desired temperature increase value, and in which said desired steam temperature change rate value, in a case of a difference between said desired temperature and said steam temperature, is set to be at a level lower than that corresponding to the case wherein such difference is large.

4. An apparatus for controlling a starting operation of a boiler according to claim 3, wherein said first arithmetic means includes a comparator which outputs, as said steam pressure change rate value, one of two signals smaller than the other signal, said two signals including a signal corresponding to a difference between said desired pressure and said steam pressure and a signal corresponding to a value given by a preset constant which is determined so as to suppress a thermal stress of said super heater means and said steam separator means or given by a function of a signal representing a thermal stress of said super heater means and said steam separator means, and wherein said first arithmetic means further includes another comparator which outputs, as said steam temperature change rate value, one of two signals being smaller than the other one, said two signals including a signal corresponding to a difference between said desired temperature and said steam temperature and a signal corresponding to a value given by a preset constant determined so as to suppress a thermal stress of said super heater means and said steam separator means or given by a function of a signal representing a thermal stress of said super heater means and said steam separator means.

5. An apparatus for controlling a starting operation of a boiler, the apparatus comprising:

a super heater means and a steam separator means;

a first valve means for bypassing steam of said super heater means;

a second valve means for bypassing steam from said super heater means to a portion other than a primary supply portion to be supplied with steam from said super heater means;

a third valve means for regulating a fuel flow to be supplied to a burner means;

a temperature detecting means for detecting a pressure of steam at a predetermined portion of the boiler;

pressure detecting means for detecting a pressure of steam in the boiler;

first arithmetic means for calculating a desired steam temperature change rate value which is given by a preset constant or function of a signal with respect to thermal stresses of a super heater outlet header and a desired steam pressure change rate value which is represented by a preset constant or function of a signal with respect to thermal stress of said steam separator, which are required for stressing thermal stress to be generated in predetermined structural portions of the boiler, on the basis of said steam temperature, said steam pressure, a desired pressure increase value and a desired temperature increase value;

second arithmetic means for calculating manipulated variables of said first valve means, said second valve means and said third valve means, respectively, on the basis of said steam temperature, said steam pressure, said desired steam temperature change rate value and said desired steam pressure change rate value obtained by said first arithmetic means; and compensation means for compensating for the respective manipulated variables obtained by said second arithmetic means on the basis of the change rate of said steam temperature and the change rate of said steam pressure.

6. An apparatus for controlling a starting operation of a boiler according to claim 5, wherein said second arithmetic means calculates the manipulated variables of said first, second and third valve means so as to minimize a fuel flow through said third valve means.

7. An apparatus for controlling a starting operation of a boiler according to claim 5, wherein said first arithmetic means includes one subarithmetic means in which said desired steam pressure change rate value is set to be "zero" in case said steam pressure equals said desired pressure increase value, and in which said desired steam pressure change rate value, in a case of a difference between said desired pressure and said steam pressure value is small, is set to be a level lower than that corresponding to a case wherein such difference is large, and wherein said first arithmetic means further includes another subarithmetic means in which said desired steam temperature change rate value is set to be "zero" in case said steam temperature equals said desired temperature increase value, and in which said desired steam temperature change rate value, in case of a difference between said desired temperature and said steam temperature, is set to be a level lower than that corresponding to a case wherein such difference is large.

8. An apparatus for controlling a starting operation of a boiler according to claim 7, wherein said first arithmetic means includes a comparator which outputs, as said steam pressure change rate value, one of two signals being smaller than the other one, said two signals including a signal corresponding to a difference between said desired pressure and said steam pressure and a signal corresponding to a value given by a preset constant which is determined so as to suppress a thermal stress of said super heater means and said steam separator means or given by a function of a signal representing a thermal stress of said super heater means and said steam separator means, and wherein said first arithmetic means further includes another comparator which outputs, as said steam temperature change rate value, one of two signals being smaller than the other one, said two signals including a signal corresponding to a difference between said desired temperature and said steam temperature and a signal corresponding to a value given by a preset constant which is determined so as to suppress a thermal stress of said super heater means and said steam separator means or given by a function of a signal representing a thermal stress of said super heater means and said steam separator means.

* * * * *